US006863126B2

(12) United States Patent
McGlothen et al.

(10) Patent No.: US 6,863,126 B2
(45) Date of Patent: Mar. 8, 2005

(54) ALTERNATE PATH MULTILAYER PRODUCTION/INJECTION

(75) Inventors: Jody R. McGlothen, Weatherford, TX (US); Henry L. Restarick, Carrollton, TX (US)

(73) Assignee: Halliburton Energy Services, Inc., Carrollton, TX (US)

( * ) Notice: Subject to any disclaimer, the term of this patent is extended or adjusted under 35 U.S.C. 154(b) by 121 days.

(21) Appl. No.: 10/253,324

(22) Filed: Sep. 24, 2002

(65) Prior Publication Data

US 2004/0055751 A1 Mar. 25, 2004

(51) Int. Cl.[7] ..... E21B 17/18

(52) U.S. Cl. ..... 166/242.1; 166/50; 166/313

(58) Field of Search ..... 166/242.5, 242.1, 166/50, 265, 100, 117.5, 117.6, 117.7, 169, 313

(56) References Cited

U.S. PATENT DOCUMENTS

| | | | | |
|---|---|---|---|---|
| 5,311,936 | A | 5/1994 | McNair et al. | |
| 5,318,122 | A | 6/1994 | Murray et al. | |
| 5,330,007 | A | 7/1994 | Collins et al. | |
| 5,339,904 | A | 8/1994 | Jennings, Jr. et al. | |
| 5,462,120 | A | 10/1995 | Gondouin | |
| 5,484,383 | A | 1/1996 | Fitch, Jr. et al. | |
| 5,680,901 | A * | 10/1997 | Gardes | 166/313 |
| 5,839,508 | A | 11/1998 | Tubel et al. | |
| 5,875,847 | A | 3/1999 | Forsyth | |
| 5,878,815 | A | 3/1999 | Collins | |
| 5,941,308 | A | 8/1999 | Malone et al. | |
| 6,079,494 | A | 6/2000 | Longbottom et al. | |
| 6,082,455 | A | 7/2000 | Pringle et al. | |
| 6,089,320 | A | 7/2000 | LaGrange | |
| 6,119,771 | A | 9/2000 | Gano et al. | |
| 6,247,532 | B1 | 6/2001 | Ohmer | |
| 6,253,846 | B1 | 7/2001 | Nazzal et al. | |
| 6,354,375 | B1 | 3/2002 | Dewey | |
| 6,422,312 | B1 * | 7/2002 | Delatorre et al. | 166/250.15 |
| 6,431,283 | B1 | 8/2002 | Dale | |
| 6,464,011 | B2 | 10/2002 | Tubel | |
| 6,615,920 | B1 * | 9/2003 | Collins et al. | 166/313 |
| 2001/0025710 | A1 | 10/2001 | Ohmer et al. | |
| 2002/0023754 | A1 | 2/2002 | Buytaert | |
| 2002/0053437 | A1 * | 5/2002 | Ohmer | 166/313 |
| 2002/0088621 | A1 | 7/2002 | Hamilton | |
| 2003/0221834 | A1 | 12/2003 | Hess et al. | |

FOREIGN PATENT DOCUMENTS

| | | | |
|---|---|---|---|
| CA | 2301966 | A1 | 9/2001 |
| GB | 2 345 933 | A | 7/2000 |
| WO | WO 01/11185 | A1 | 2/2001 |
| WO | WO 01/71151 | A1 | 9/2001 |

OTHER PUBLICATIONS

U.S. Appl. No. 10/253,671, filed May 19, 2004.
U.S. Appl. No. 10/253,136, filed Jan. 5, 2004.
International Search Report for application No. PCT/US03/26791.
International Search Report for application No. PCT/US03/26360.
U.K. Search Report for application No. GB 0322266.8.
U.K. Search Report for application No. GB 0322266.8.
U.S. Appl. No. 10/253,324, filed Mar. 30, 2004.

* cited by examiner

*Primary Examiner*—David Bagnell
*Assistant Examiner*—Daniel P Stephenson
(74) *Attorney, Agent, or Firm*—Marlin R. Smith

(57) ABSTRACT

Alternate path multilateral production/injection. In a described embodiment, a system for drilling and completing a well having intersecting first and second wellbores comprises a casing string positioned in the first wellbore; and at least one apparatus interconnected in the casing string. The apparatus includes a mandrel having intersecting first and second passages formed therein. The first passage extends longitudinally through the mandrel and is in fluid communication with an interior of the casing string. The second passage extends laterally relative to the first passage and is configured for drilling the second wellbore therethrough. The mandrel further includes at least one third passage or alternate path extending longitudinally in the mandrel.

101 Claims, 8 Drawing Sheets

ALTERNATE PATH MULTILAYER PRODUCTION/INJECTION

CROSS-REFERENCE TO RELATED APPLICATIONS

The present application is related to two copending applications: U.S. appl. Ser. No. 10/253,671, entitled SURFACE CONTROLLED SUBSURFACE LATERAL BRANCH SAFETY VALVE AND FLOW CONTROL SYSTEM, and U.S. application Ser. No. 10/253,136, entitled MULTILATERAL INJECTION/PRODUCTION/STORAGE COMPLETION SYSTEM, each filed concurrently herewith, and the disclosures of each being incorporated herein by this reference.

BACKGROUND

The present invention relates generally to operations performed and equipment utilized in conjunction with a subterranean well and, in an embodiment described herein, more particularly provides a multilateral well injection/production system utilizing at least one alternate path.

In general, flow control between a main or parent wellbore and multiple branch wellbores intersected by the parent wellbore is accomplished either by installing a production or completion string in casing lining the parent wellbore, or by installing flow control devices in the individual branch wellbores. Each of these types of systems has its own disadvantages. For example, the completion string in the parent wellbore obstructs the interior of the casing, and the flow control devices in the branch wellbores require difficult and time-consuming procedures to access the devices for maintenance, provide power to and control of the devices, etc.

Furthermore, these prior systems and methods do not provide for conducting other beneficial operations in a multilateral well, for example, drilling one branch wellbore while producing from or performing other operations in another branch wellbore, separating hydrocarbons and water from fluid flowed out of one branch wellbore and injecting the water into another branch wellbore, retrieving flow control devices for maintenance while leaving the rest of the completion system undisturbed, etc.

Therefore, it is well known to those skilled in the art that improved systems and methods for drilling and completing multilateral wells are needed.

SUMMARY

In carrying out the principles of the present invention, in accordance with an embodiment thereof, a completion system is provided which solves at least some of the above described problems in the art. Methods of drilling and completing multilateral wells are also provided. These systems and methods utilize an apparatus which includes a mandrel having various passages formed therein. The passages are uniquely configured and interconnected to enable a variety of operations to be performed in a multilateral well.

In one aspect of the invention, a system for completing a well is provided. The system includes two apparatuses interconnected in a casing string in a wellbore. An internal flow passage of the casing string extends through a first passage of each of the apparatuses. Each of the apparatuses further has a second passage intersecting the first passage. In addition, a third passage of each of the apparatuses provides fluid communication between the apparatuses separate from the casing string flow passage.

In another aspect of the invention, another system for completing a well having intersecting wellbores is provided. The system includes a casing string positioned in one of the wellbores and at least one apparatus interconnected in the casing string. The apparatus includes a mandrel having intersecting passages formed therein.

The first passage extends longitudinally through the mandrel and is in fluid communication with an interior of the casing string. The second passage extends laterally relative to the first passage and is configured for drilling the other wellbore therethrough. The mandrel further includes at least one third passage extending longitudinally in the mandrel.

In yet another aspect of the invention, a method of drilling and completing a well having intersecting wellbores is provided. The method includes the steps of: interconnecting at least one apparatus in a casing string having an internal longitudinal flow passage formed therethrough, the apparatus including first and second passages formed therein, the first passage extending longitudinally through the apparatus and forming a portion of the casing string flow passage; positioning the apparatus in one of the wellbores at a location where it is desired to drill the other wellbore; drilling the other wellbore by passing a drill string through the first and second passages; and flowing fluid between the second wellbore and a remote location through a third passage of the apparatus, the third passage being isolated from the first passage in the apparatus.

In a further aspect of the invention, a system for completing a well having intersecting wellbores is provided. The system includes at least one apparatus positioned in one of the wellbores and having first and second passages formed therethrough. The first passage forms a portion of an internal flow passage of a casing string in which the apparatus is interconnected, and the second passage provides access between the first passage and the other wellbore. The apparatus also has a third passage isolated from the first passage while fluid is flowed between the third passage and the other wellbore.

In a still further aspect of the invention, a method of completing a well having a first wellbore intersecting each of second and third wellbores is provided. First and second apparatuses are interconnected in a casing string. Each of the apparatuses has a first passage formed therethrough which forms a portion of an internal flow passage of the casing string, and a second passage intersecting the first passage and extending laterally relative to the first passage.

The casing string is positioned in the first wellbore. Fluid is received from one of the second and third wellbores into one of the first and second apparatuses. Hydrocarbons and water are separated from the fluid received into the one of the first and second apparatuses. One of the separated hydrocarbons and water is flowed to the other of the first and second apparatuses through a third passage interconnected between the first and second apparatuses.

These and other features, advantages, benefits and objects of the present invention will become apparent to one of ordinary skill in the art upon careful consideration of the detailed description of representative embodiments of the invention below and the accompanying drawings.

DETAILED DESCRIPTION

Figure 1:
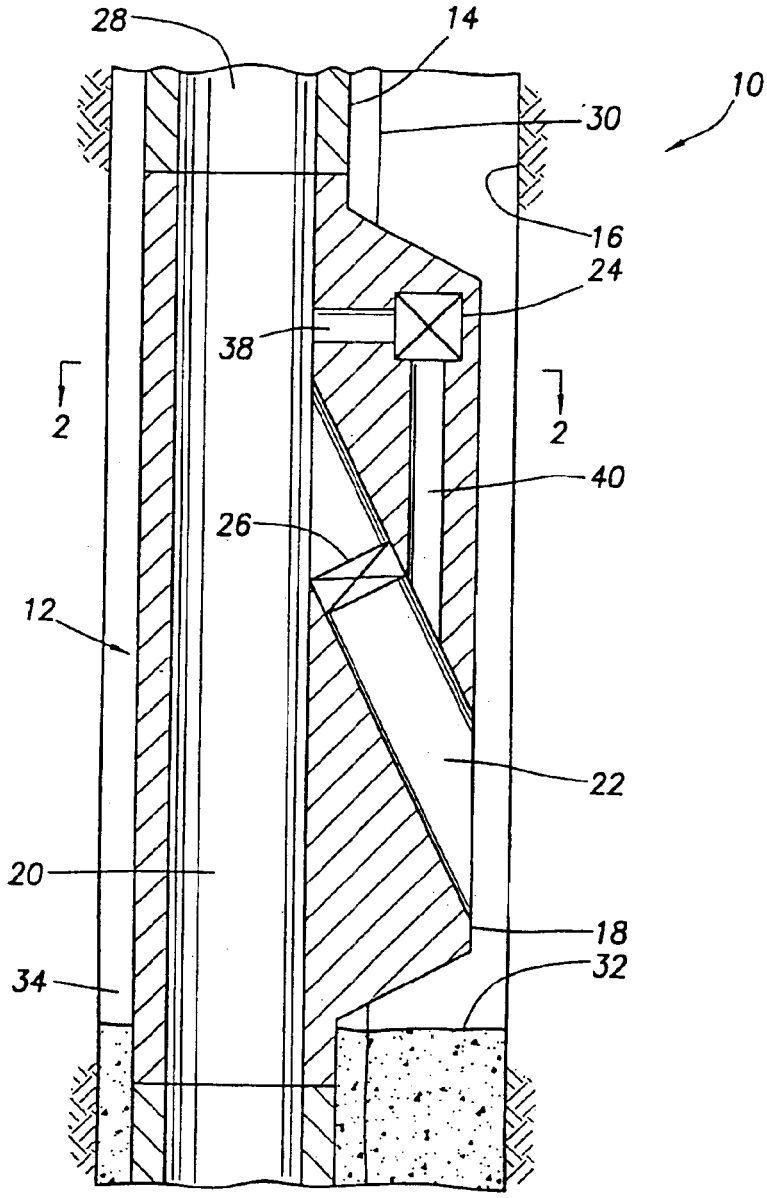
FIG. 1 is a schematic cross-sectional view of a first system and method embodying principles of the present invention.

Representatively illustrated in FIG. 1 is a system 10 which embodies principles of the present invention. In the following description of the system 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the system 10, an apparatus 12 is interconnected in a casing string 14 and positioned in a main or parent wellbore 16. As used herein, the terms "casing", "casing string", "cased" and the like are used to indicate any tubular string used to form a protective lining in a wellbore. A casing string may be made of any material, such as steel, plastic, composite materials, aluminum, etc. A casing string may be made up of separate segments, or it may be a continuous tubular structure. A casing string may be made up of elements known to those skilled in the art as "casing" or "liner".

The apparatus 12 includes a mandrel 18 in which several passages 20, 22 are formed. The mandrel 18 may be made as a single structure, or it may be made up of any number of separate elements.

The passage 20 extends longitudinally through the mandrel 18 and forms a part of an internal flow passage 28 through the casing string 14. The passage 22 intersects the passage 20 and extends laterally relative to the passage 20. A deflector (not shown) may be installed in the mandrel 18 to deflect cutting tools, etc., from the passage 20 and through the passage 22 to drill a branch wellbore, and after the branch wellbore is drilled, to deflect completion equipment, tools, etc., from the parent wellbore 16 into the branch wellbore.

A flow control device 24 is interconnected between the passages 20, 22 via passages 38, 40 to control flow therebetween when a plug 26 is installed to block flow directly between the passages. The flow control device 24 may be controlled and communicated with using lines 30 extending to a remote location, such as the earth's surface or another location in the well. Sensors (not shown) may be included in the apparatus 12 to monitor downhole conditions, interface with the flow control devices 24, etc. The sensors may also be connected to the lines 30. Alternatively, the flow control device 24 and/or sensors may be controlled by or communicate with the remote location via any form of telemetry.

A similar apparatus is more fully described in the application incorporated herein and entitled SURFACE CONTROLLED SUBSURFACE LATERAL BRANCH SAFETY VALVE AND FLOW CONTROL SYSTEM. The various alternative embodiments and optional features and configurations described in the incorporated application may also be used in the system 10, without departing from the principles of the invention.

The apparatus 12 and the remainder of the casing string 14 are being cemented in the parent wellbore 16 as depicted in FIG. 1. For this purpose, cement 32 is flowed through an annulus 34 formed between the casing string 14 and the wall of the wellbore 16. As used herein, the terms "cementing", "cement" and the like are used to indicate any process using a material which is flowed between a tubular string and a wellbore, and which secures the tubular string in the wellbore and prevents fluid flow therebetween. Cement may include cementitious material, epoxies, other polymer materials, any hardenable and/or adhesive sealing material, etc.

Since the mandrel 18 extends outward from the remainder of the casing string 14 as depicted in FIG. 1, some difficulty may be experienced in flowing the cement 32 through the annulus 34 about the mandrel 18. This situation could be remedied by configuring the mandrel 18 so that it does not extend outward from the remainder of the casing string 14. However, the mandrel 18 has instead been configured to permit the cement 32 to flow more readily from one opposite end to the other of the mandrel.

Figure 2:
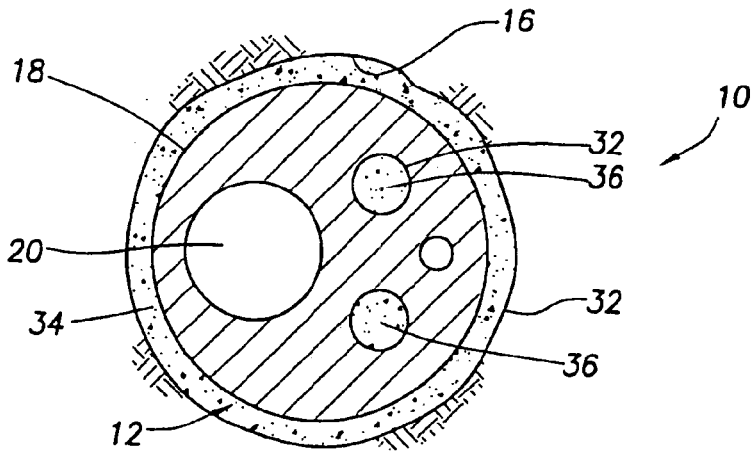
FIG. 2 is a cross-sectional view through the first system and method, taken along line 2—2 of FIG. 1.

Referring additionally now to FIG. 2, a cross-sectional view of the mandrel 18 in the wellbore 16 is representatively illustrated, taken along line 2—2 of FIG. 1. In this view it may be seen that the mandrel 18 has multiple alternate paths or passages 36 formed longitudinally therethrough between its opposite ends. The passages 36 permit the cement 32 to flow through the mandrel 18. Note that the passages 36 are isolated from the passages 20, 22 and the flow control device 24 in the mandrel 18.

Figure 3:
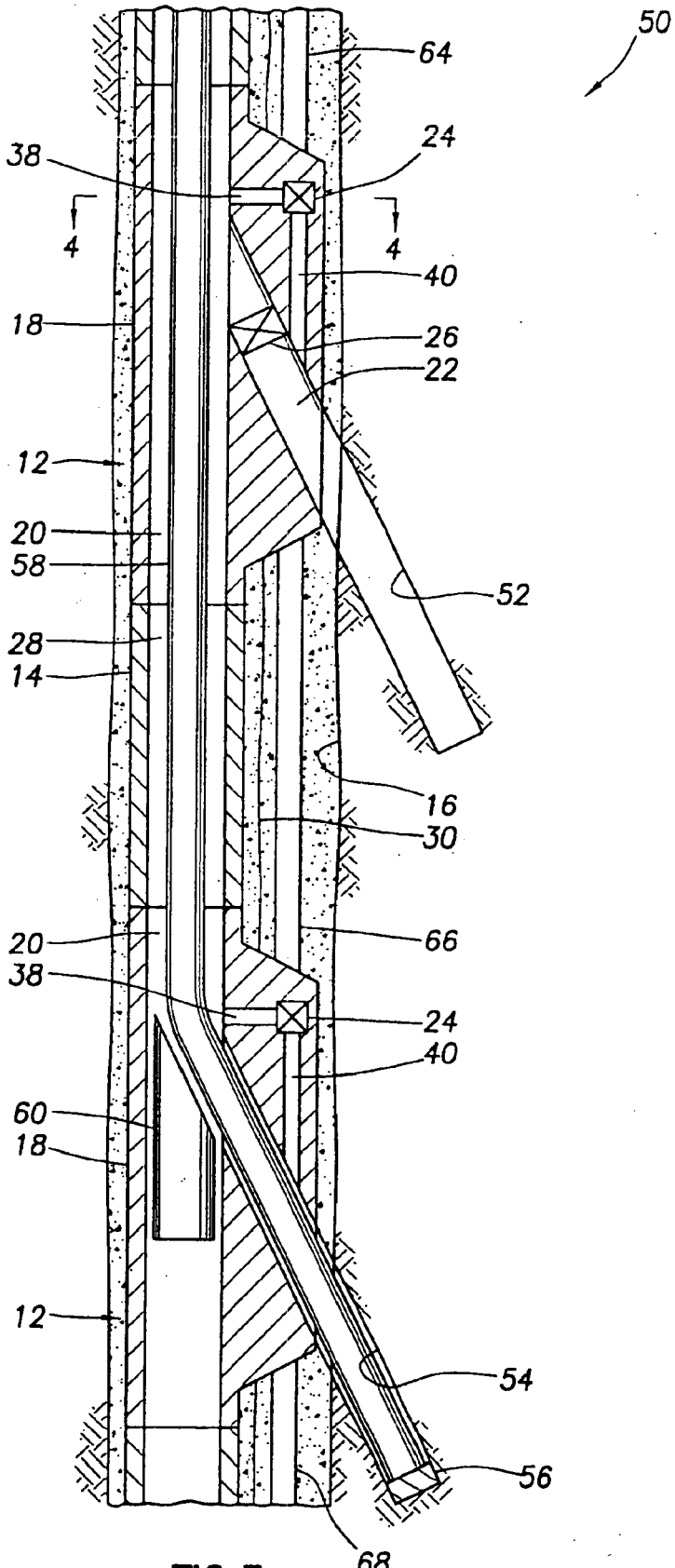
FIG. 3 is a schematic cross-sectional view of a second system and method embodying principles of the invention.

Referring additionally now to FIG. 3, another system 50 embodying principles of invention is representatively illustrated. The system 50 demonstrates another way in which one or more alternate paths in the apparatus used therein may provide increased functionality in multilateral wells. The system 50 includes elements which are similar in many respects to those in the system 10 described above, so the same reference numbers are used to indicate similar elements in FIG. 3.

In the system 50, two of the apparatuses 12 are interconnected in the casing string 14 and positioned and cemented in the parent wellbore 16. A branch wellbore 52 has been drilled extending outward from the parent wellbore 16 by deflecting one or more cutting tools from the passage 20 through the passage 22 of the upper mandrel 18. After drilling the branch wellbore 52, the plug 26 is installed to prevent direct flow between the passages 20, 22 of the upper mandrel.

Another branch wellbore 54 is then drilled through the lower mandrel 18 by deflecting a drill string 58 including one or more cutting tools 56 from the passage 20 through the passage 22 using a deflector, such as a drilling whipstock 60 positioned in the passage 20. It will be appreciated by those skilled in the art that would be beneficial to be able to perform operations in the upper branch wellbore 52 while the lower branch wellbore 54 is being drilled. For example, fluid could be produced from the upper branch wellbore 52 to generate revenue while the lower branch wellbore 54, or another branch wellbore, is being drilled.

To enable these other operations to be performed simultaneously with drilling in the lower branch wellbore 54, the upper mandrel 18 is provided with one or more alternate paths, similar in some respects to the passages 36 shown in FIG. 2 and described above. Representatively illustrated in FIGS. 4A–C are several alternate configurations and interconnections of these alternate paths, depicted as cross-sectional views of the upper mandrel 18, taken along line 4—4 of FIG. 3.

Figure 4A:
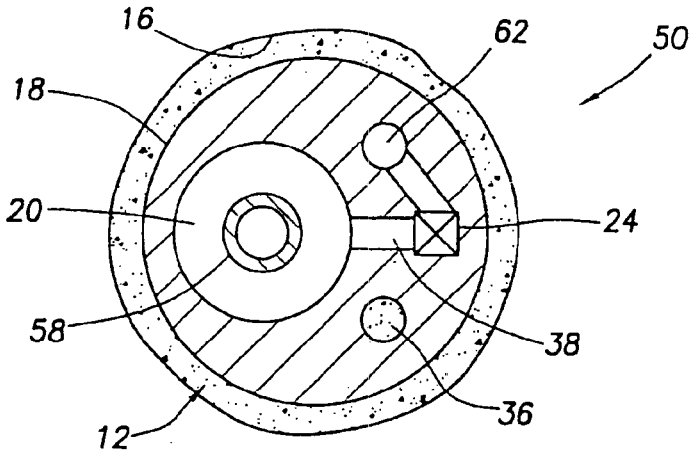
FIGS. 4A–C are alternate cross-sectional views through the second system and method, taken along line 4—4 of FIG. 3.
Figure 4B:
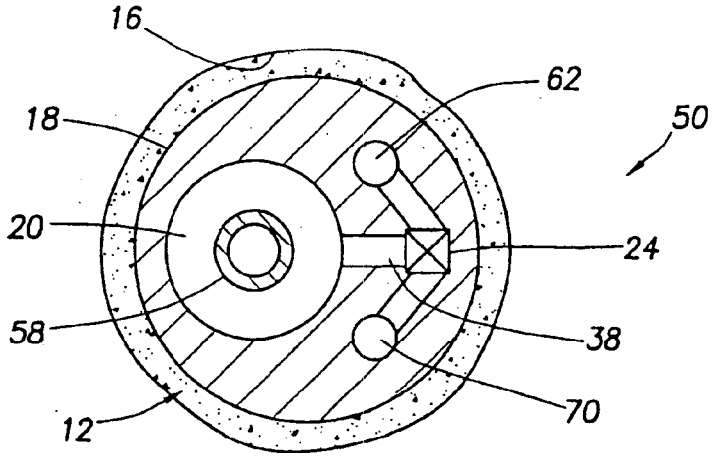
Figure 4C:
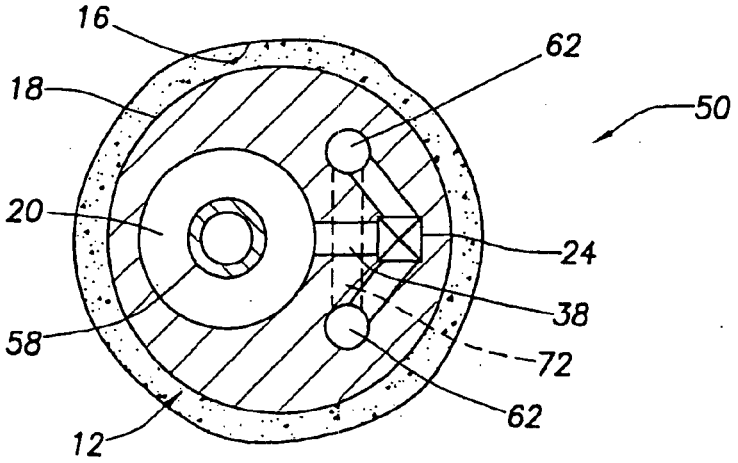

In FIG. 4A, one of the alternate paths in the mandrel 18 is the passage 36 described above, which permits flow of cement 32 between opposite ends of the mandrel. Another passage 62 is formed in the mandrel 18 and is in fluid communication with the flow control device 24. The flow control device 24 controls flow between the passage 62 and the passage 22 in the mandrel 18 which is in fluid communication with the branch wellbore 52.

As depicted in FIG. 4A, the flow control device 24 is a "three way" valve which selectively permits and prevents fluid communication between the passage 22 and either of the passages 20 and 62. Thus, the device 24 may be opened to permit flow between the passages 22, 62 or between the passages 20, 22, and the device may be closed to prevent flow between the passage 22 and each of the passages 20, 62. The flow control device 24 could also, or alternatively, be a choke or another type of flow control device in keeping with the principles of the invention.

The passage 62 is in fluid communication with a tubular string 64 extending to a remote location (see FIG. 3). By opening the flow control device 24 to permit flow between the passages 22, 62, fluid may be produced from the branch wellbore 52 to the remote location through the tubular string 64 while the other branch wellbore 54 is being drilled through the passage 20.

As another alternative, the branch wellbore 52 may be stimulated, such as by acidizing, fracturing, etc., by flowing stimulation fluid from the remote location through the tubular string 64, through the passage 62, through the flow control device 24, through the passage 22 and into the branch wellbore. These types of stimulation operations may be performed in the upper branch wellbore 52 while the lower branch wellbore 54 is being drilled.

As yet another alternative, a formation test may be performed in the upper branch wellbore 52 while the lower branch wellbore 54 is being drilled. For example, the flow control device 24 may be closed to perform a pressure buildup or shut in test procedure, the flow control device may be opened to flow between the passages 22, 62 to perform a pressure drawdown or flow test procedure, etc., with the associated pressures and temperatures being monitored using the sensors in the apparatus 12 described in the incorporated application.

Additional versatility may be achieved by providing fluid communication between passages 62 formed in both of the upper and lower mandrels 18 using a tubular string 66 interconnected between the mandrels. That is, each of the upper and lower mandrels 18 is configured as depicted in FIG. 4A, with the passage 62 of each mandrel being in fluid communication with the passage 62 of the other mandrel. In this manner, fluid injected or produced through the tubular string 64 from or to the remote location can be directed to either the passage 22 of the upper mandrel 18 or the passage 22 of the lower mandrel 18.

One example of this increased versatility is that the upper branch wellbore 52 could be drilled while fluid is produced from the lower branch wellbore 54. In this situation, the flow control device 24 of the lower apparatus 12 would be open to flow between the passages 22, 62, while the flow control device of the upper apparatus 12 would be closed to such flow.

Another example of this increased versatility is that fluid could be produced from both of the branch wellbores 52, 54 while yet another branch wellbore is being drilled, either above or below the illustrated branch wellbores 52, 54. In this situation, the flow control devices 24 in each of the mandrels 18 would be open to flow between the respective passages 22, 62.

It should also be understood that the combinations of operations which may be performed in separate wellbores using the system 50 is not limited to production and drilling. For example, one wellbore could be stimulated while a formation test is performed in another wellbore. Any combination and number of operations may be performed in any combination and number of wellbores in keeping with the principles of the invention.

Another tubular string 68 may provide fluid communication between the passages 62 in the illustrated mandrels 18 and any number of additional apparatuses 12 interconnected in the casing string 14. These additional apparatuses 12 may be positioned above or below the illustrated apparatuses.

In FIG. 4B an alternate configuration of the upper mandrel 18 is depicted. This configuration includes the passage 62 described above. However, instead of the passage 36, the configuration shown in FIG. 4B includes another passage 70 similar to the passage 62.

This configuration may be useful, for example, in circumstances in which it is desired to flow fluids between one or more of the mandrels 18 and the remote location. One fluid, such as steam, water or a stimulation fluid, could be injected into selected one or more branch wellbores through the passage 62, while another fluid, such as oil or gas, is produced from other selected one or more branch wellbores through the other passage 70. In that situation, the flow control device(s) 24 of the mandrel(s) 18 selected for injection would be open to flow between the corresponding passage(s) 62 and the respective passage(s) 22, and the flow control devices of the mandrel(s) selected for production would be open to flow between the corresponding passage(s) 70 and the respective passage(s) 22.

In order for the flow control device 24 to selective control flow between the passages 20, 22, 62, 70, the flow control device may be a "four way" valve. Alternatively, separate flow control devices may be used to control corresponding separate fluid communication selections. For example, one flow control device may be used to control flow between the passages 22, 62, while another flow control device is used to control flow between the passages 22, 70, and yet another flow control device is used to control flow between the passages 20, 22. Thus, any combination and number of flow control devices may be used, without departing from the principles of the invention.

In FIG. 4C another alternate configuration of the mandrel 18 is depicted. In this alternate configuration, the passage 62 is in fluid communication with a second similar passage 62. This fluid communication is provided by a passage 72 shown in dashed lines in FIG. 4C.

This configuration may be useful in situations in which a larger flow area is desired for the passage 62 than may be provided by a single larger diameter passage, for example, due to space limitations in the mandrel 18. As another example, the passage 62 may be susceptible to plugging by material, such as sand, carried in the fluid flowed therethrough, and so a redundant passage 62 is available in the event one of the passages becomes plugged.

The above described alternate configurations of the mandrel 18 and alternate paths formed therein as depicted in FIGS. 4A–C are given merely as examples of the wide variety of options made possible by the principles of the invention. Many other configurations are possible, and these other configurations are within the scope of the invention described and claimed herein.

Figure 5:
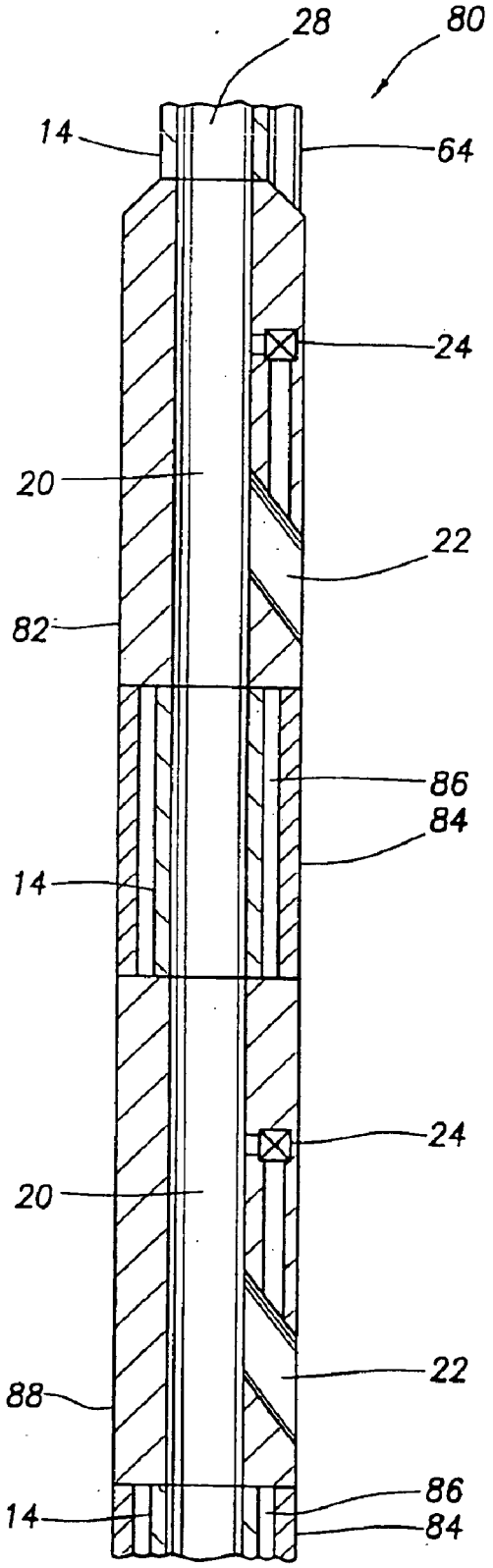
FIG. 5 is a schematic cross-sectional view of a third system and method embodying principles of the invention.

Referring additionally now to FIG. 5, another system 80 embodying principles of the invention is representatively illustrated. For illustrative clarity, the system 80 is depicted apart from the well in which it is installed. Elements of the system 80 which are similar to elements described above are indicated in FIG. 5 using the same reference numbers.

In the system 80, an alternate path, such as the passage 62 described above, is formed in a mandrel 82 and extends to a remote location through the tubular string 64 connected to the mandrel. The mandrel 82 is connected in the casing string 14 at an upper end thereof. However, a lower end of the mandrel 82 is connected in the casing string 14, and is also connected to another tubular string 84.

An annulus 86 between the casing string 14 and the tubular string 84 provides fluid communication between the passages 62 in the mandrel 82 and another mandrel 88 also connected to the casing string and tubular string. The passages 62 extend through the annulus 86 in a similar manner to that in which the passages 62 extend through the tubular string 66 between the mandrels 18 as depicted in FIG. 3. Additional mandrels may be interconnected to the mandrel 88 using more of the casing string 14 and the tubular string 84 therebelow.

Figure 6:
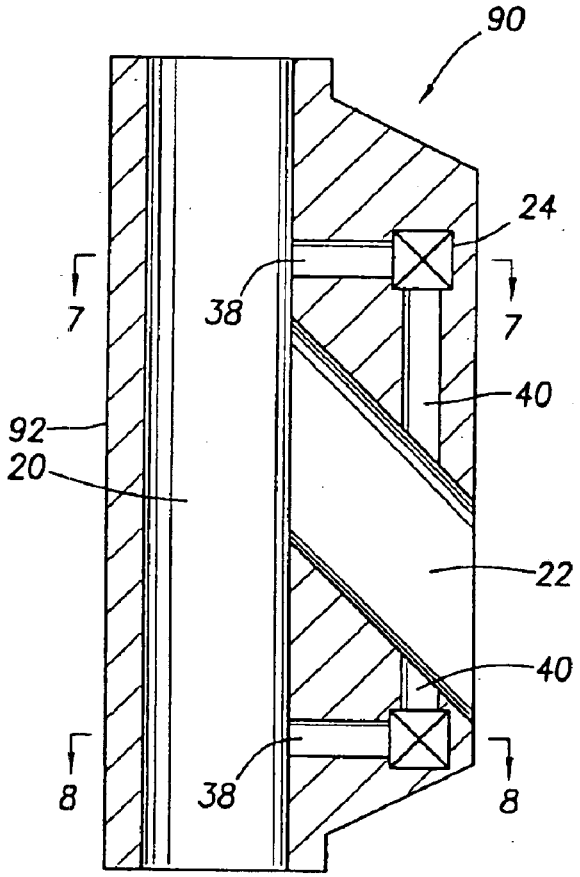
FIG. 6 is a schematic cross-sectional view of a fourth system and method embodying principles of the invention.

Referring additionally now to FIG. 6, another system 90 embodying principles of the invention is representatively illustrated. For illustrative clarity, the system 90 is illustrated apart from the well in which it is installed. Elements of the system which are similar to those previously described are indicated in FIG. 6 using the same reference numbers.

The system 90 includes a mandrel 92 which has the passages 20, 22 formed therein. However, instead of one of the flow control devices 24, the system 90 includes two of the flow control devices for selectively controlling flow between the passages 20, 22. One of the flow control devices 24 is positioned above the passage 22, and another of the flow control devices is positioned below the passage 22. Any number of the mandrels 92 may be interconnected, for example, as described above and depicted in FIGS. 3 & 5.

Figure 7:
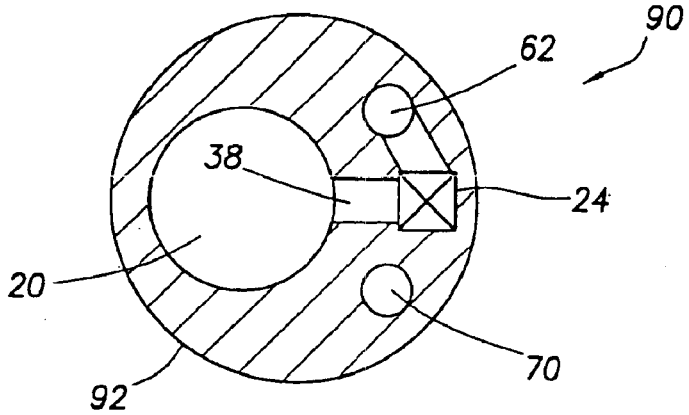
FIG. 7 is a cross-sectional view of the fourth system and method, taken along line 7—7 of FIG. 6.
Figure 8:
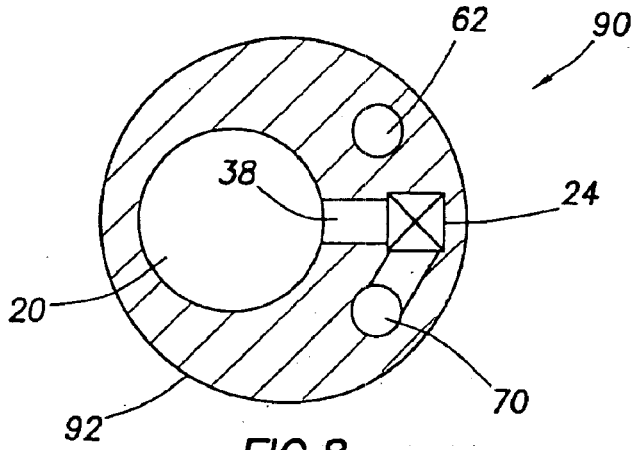
FIG. 8 is a cross-sectional view of the fourth system and method, taken along line 8—8 of FIG. 6.

In FIG. 7 a cross-sectional view through the mandrel 92 is illustrated, taken along line 7—7 of FIG. 6, which passes through the upper flow control device 24. In FIG. 8 a cross-sectional view through the mandrel 92 is illustrated, taken along line 8—8 of FIG. 6, which passes through the lower flow control device 24. These views show the manner in which the flow control devices 24 are used to control flow between the passages 20, 22 and the respective passages 62, 70.

As mentioned above in the description of the alternate configuration of the system 50 depicted in FIG. 4B, any number of flow control devices may be used to control flow between the passages 20, 22, 62, 70. In the system 90, two of the flow control devices 24 are used. The upper flow control device 24 shown in FIG. 7 controls flow between the passage 22 and each of the passages 20, 62. The lower flow control device 24 shown in FIG. 8 controls flow between the passage 22 and each of the passages 20, 70. Each of the flow control devices 24 is a "three way" valve, but other types of flow control devices may be used, and other combinations and numbers of flow control devices may be used, in keeping with the principles of the invention.

As an example of use of the system 90, the upper flow control device 24 may be opened to flow between the passages 62, 22 when it is desired to flow fluid from the passage 62 into the passage 22, such as to stimulate a branch wellbore extending outward from the passage 22, dispose of water produced from another wellbore, etc., and the lower flow control device may be opened to flow between the passages 70, 22 when it is desired to flow fluid from the passage 22 into the passage 70, such as to produce fluid from a branch wellbore, perform a formation test, etc. Of course, other types of operations, and other combinations and numbers of operations, may be performed using the system 90 in keeping with the principles of the invention.

Figure 9:
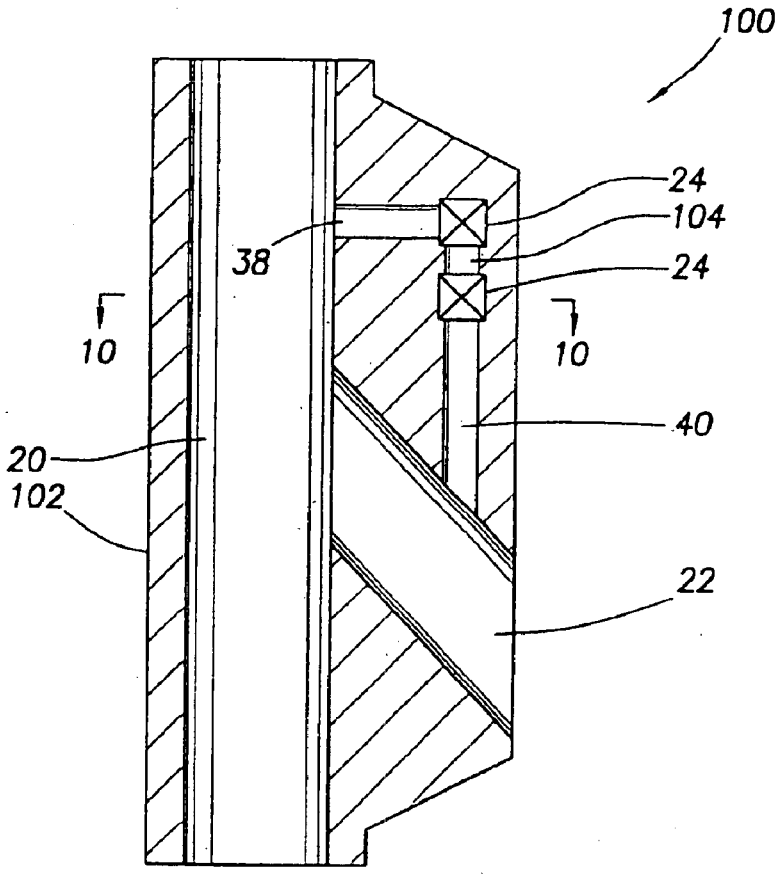
FIG. 9 is a schematic cross-sectional view of a fifth system and method embodying principles of the invention.

Referring additionally now to FIG. 9, another system 100 embodying principles of the invention is representatively illustrated. For illustrative clarity, the system 100 is illustrated apart from the well in which it is installed. Elements of the system which are similar to those previously described are indicated in FIG. 9 using the same reference numbers.

The system 100 includes a mandrel 102 which has the passages 20, 22 formed therein. As with the system 90 described above, the system 100 includes two of the flow control devices 24. However, only one of the flow control devices 24 (the upper flow control device as depicted in FIG. 9) controls flow between the passages 20, 22. The lower flow control device 24 controls flow between the passages 22, 70. Any number of the mandrels 102 may be interconnected, for example, as described above and depicted in FIGS. 3 & 5.

Figure 10:
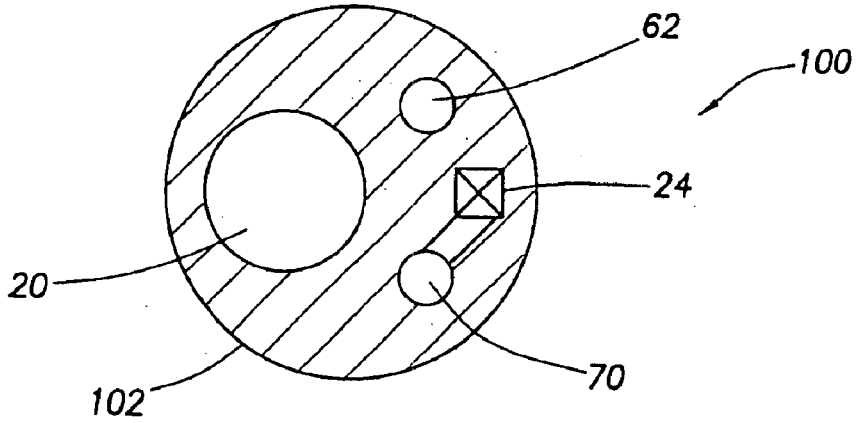
FIG. 10 is a cross-sectional view of the fifth system and method, taken along line 10—10 of FIG. 9.

In FIG. 10 a cross-sectional view of the mandrel 102 is illustrated, taken along line 10—10 of FIG. 9, which passes through the lower flow control device 24. In this view it may be seen that the lower flow control device 24 is interconnected between the passages 40, 70. The lower flow control device 24 is a "three way" valve in that it selectively controls flow between the passage 40 (and, thus, the passage 22) and either of the passage 70 and a passage 104 extending upward to the upper flow control device.

When it is desired to permit flow between the passages 22, 70, the lower flow control device 24 is opened to such flow. In this situation, the lower flow control device 24 may or may not also permit flow between the passages 70, 104, depending upon the construction of the flow control device. However, flow between the passages 20, 70 is preferably not permitted at the same time flow between the passages 22 is permitted by the lower flow control device 24.

When it is desired to permit flow between the passages 20, 70, the upper flow control device 24 is opened to permit flow between the passages 38, 104, and the lower flow control device is opened to flow between the passages 70, 104. This situation may be desirable, for example, to inject a chemical, such a corrosion inhibitor or paraffin solvent, from the passage 70 into the passage 20 during production of the well.

Yet another flow control device 24 could be provided in the mandrel 102 to control flow between the passages 40, 62, in a manner similar to that in which the lower flow control device controls flow between the passages 40, 70. The system 100 further demonstrates the extraordinary versatility in multilateral well operations provided by the invention.

Figure 11:
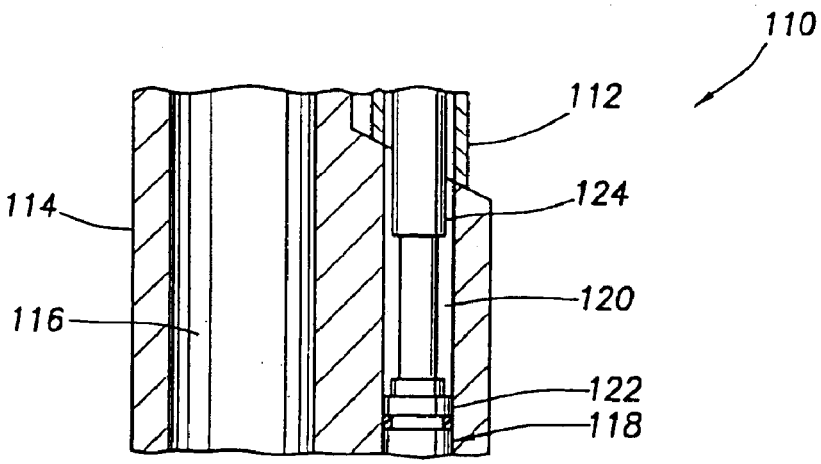
FIG. 11 is a schematic cross-sectional view of a sixth system and method embodying principles of the invention.

Referring additionally now to FIG. 11, another system 110 embodying principles of the invention is representatively illustrated. Only a portion of the system 110 is illustrated in FIG. 11 for illustrative clarity.

As described above for the system 50 depicted in FIG. 3, the system 110 has a tubular string 112 connected to a mandrel 114. A flow passage 116 of a casing string (not shown) extends through the mandrel 114. A flow control device 118 (representatively illustrated in FIG. 11 as a sliding sleeve-type valve) is positioned in a passage 120 in the mandrel 114. The passage 120 extends through the tubular string 112.

As depicted in FIG. 11, a tool 124, such as retrieving tool or shifting tool, has been conveyed through the tubular string 112 and is engaged with a portion 122 (such as a sleeve or other closure member, actuator, battery, etc.) of the flow control device 118. Representatively, the tool 124 is a retrieving tool and is retrieving the sleeve 122 to the surface through the tubular string 112 for maintenance.

However, the tool 124 could instead be retrieving a battery, actuator or other portion 122 of the flow control device 118 for repair, maintenance, inspection, recharging or replacement, etc. As another alternative, the tool 124 could be a shifting tool used to manually shift the sleeve 122 to a desired position in the event that an actuator of the flow control device 118 fails to operate properly.

All of the operations described above in relation to the system 110 may be performed without obstructing the passage 116 or interfering with flow through the passage 116. Thus, the system 110 further demonstrates the additional convenience and functionality provided by the alternate paths incorporated into systems embodying the principles of the invention.

Figure 12:
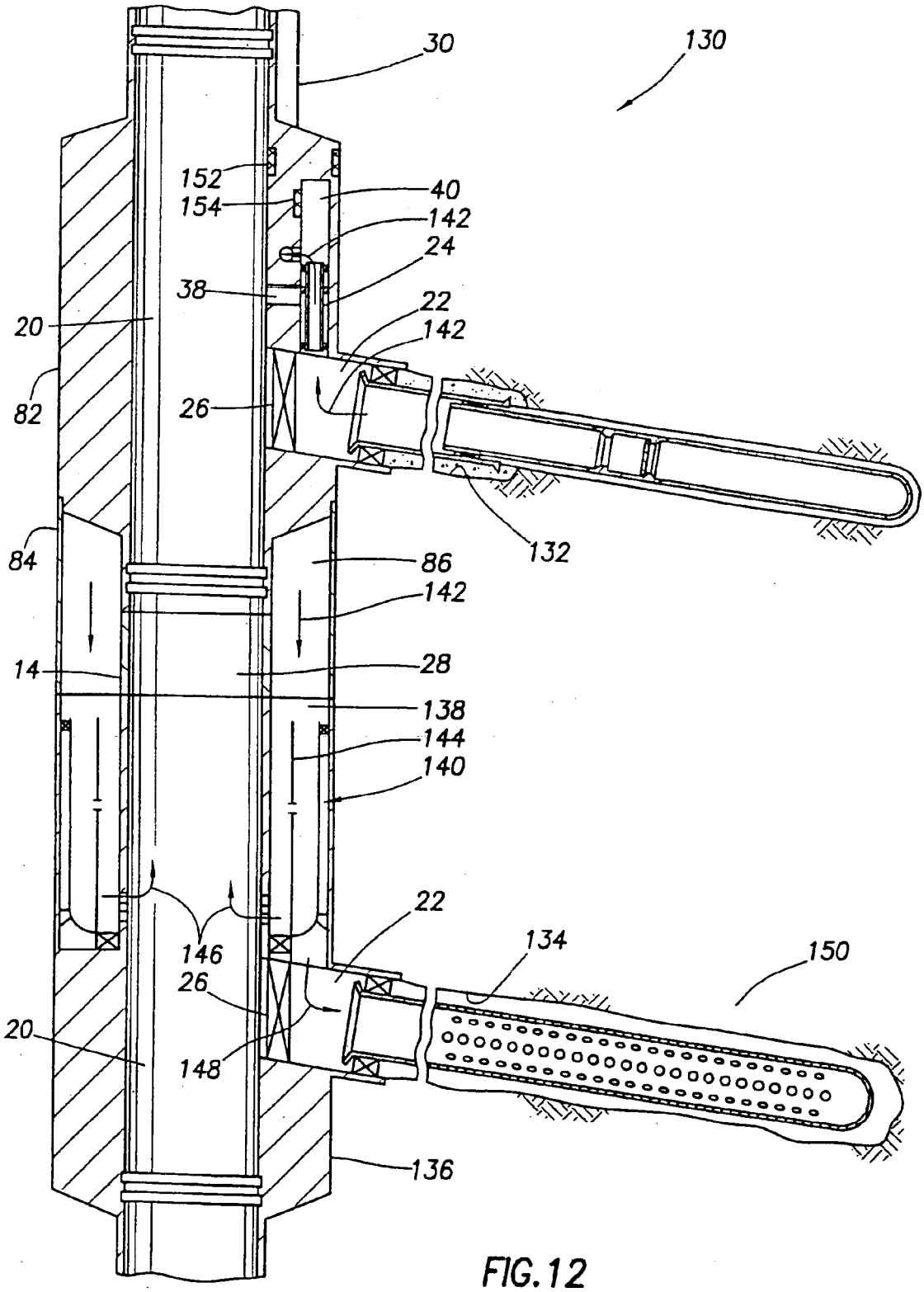
FIG. 12 is a schematic cross-sectional view of a seventh system and method embodying principles of the invention.

Referring additionally now to FIG. 12, another system 130 embodying principles of the invention is representatively illustrated. For illustrative clarity, the system 130 is depicted apart from the parent wellbore 16 in which it is installed, however, two branch wellbores 132, 134 drilled through passages 22 of respective mandrels 82, 136 are shown in FIG. 12. Elements of the system 130 which are similar to elements previously described are indicated in FIG. 12 using the same reference numbers.

The system 130 is similar in some respects to the system 80 described above and illustrated in FIG. 5. That is, the upper mandrel 82 is connected to another mandrel 136 using a casing string 14 and a tubular string 84 extending between the mandrels. The annulus 86 between the casing string 14 and the tubular string 84 provides fluid communication between the passage 62 in the upper mandrel 82 and another passage 138 in the lower mandrel 136.

However, in the system 130, the passage 138 in the lower mandrel 136 is an annular chamber in which is disposed a centrifugal-type separator 140. Centrifugal-type separators for separating hydrocarbons and water from fluid received therein are known to those skilled in the art, and an example is described in U.S. Pat. No. 5,484,383. The entire disclosure of that patent is incorporated herein by this reference.

In the system 130, the separator 140 is not positioned within a casing string, but is instead positioned in the annular passage 138 which extends about the passage 20 (and, thus, the internal passage 28 of the casing string 14). Fluid (indicated by arrows 142) containing a mixture of water and hydrocarbons is produced from the upper branch wellbore 132 into the passage 22 of the upper mandrel 82. The flow control device 24 permits the fluid 142 to flow from the passage 22 into the passage 62 in the upper mandrel 82.

The fluid 142 then flows downward through the annulus 86 between the casing string 14 and the tubular string 84. Note that it is not necessary for the fluid to flow through the annulus 86, since the system 130 could be configured similar to the system 50 shown in FIG. 3, wherein a tubular string 66 external to the casing string 14 is interconnected between the mandrels 18.

The fluid 142 flows into the annular passage 138 wherein it enters the separator 140. The separator includes a rotating assembly 144 which, through centripetal force transmitted to the fluid 142, separates relatively dense fluid (such as water) from relatively light fluid (such as oil or gas). Accordingly, the separator 140 directs the separated hydrocarbons (indicated by arrows 146) to flow inward into the passage 20, and directs the separated water (indicated by arrow 148) to flow into the passage 22 of the lower mandrel 136.

The hydrocarbons 146 are produced through the casing string passage 28 to a remote location, such as the earth's surface or another location in the well. The water 148 is flowed into the lower branch wellbore 134, where it is injected into a disposal formation 150. The formation 150 could be the same as the formation from which the mixed fluid 142 was originally produced, or it could be another formation or zone.

Note that the system 130 performs the original production of the fluid 142, the separation of the hydrocarbons 146 and water 148, production of the hydrocarbons, and injection of the water into the disposal formation 150, without obstructing the casing string passage 28 at all. Thus, the system 130 further demonstrates the benefits which may be achieved in systems incorporating principles of the invention.

Although the separator 140 is depicted in the system 130 as being positioned in the annular passage 138, it should be clearly understood that the separator could be otherwise positioned in keeping with the principles of the invention. For example, the separator 140 could be retrievable from the mandrel 136 for maintenance, etc. The separator 140 could be configured as described in the incorporated U.S. Pat. No. 5,484,383 and conveyed into the passage 20 on wireline or on a rigid or coiled tubular string, such as a production tubing string, through which the hydrocarbons 146 are produced. In that case, the fluid 142 would be received into the separator 140 in the production tubing string, the hydrocarbons 146 would be separated from the water 148, the water would be flowed back out of the production tubing string into the lower mandrel 136, and the hydrocarbons would be produced through the production tubing string.

Although the hydrocarbons 146 and water 148 are separately indicated in FIG. 12, it will be appreciated by those skilled in the art that, in general, separators do not perform a perfect job of separating fluids. Therefore, the separated hydrocarbons 146 may contain some water, and the separated water 148 may contain some hydrocarbons, without departing from the principles of the invention.

Figure 13:
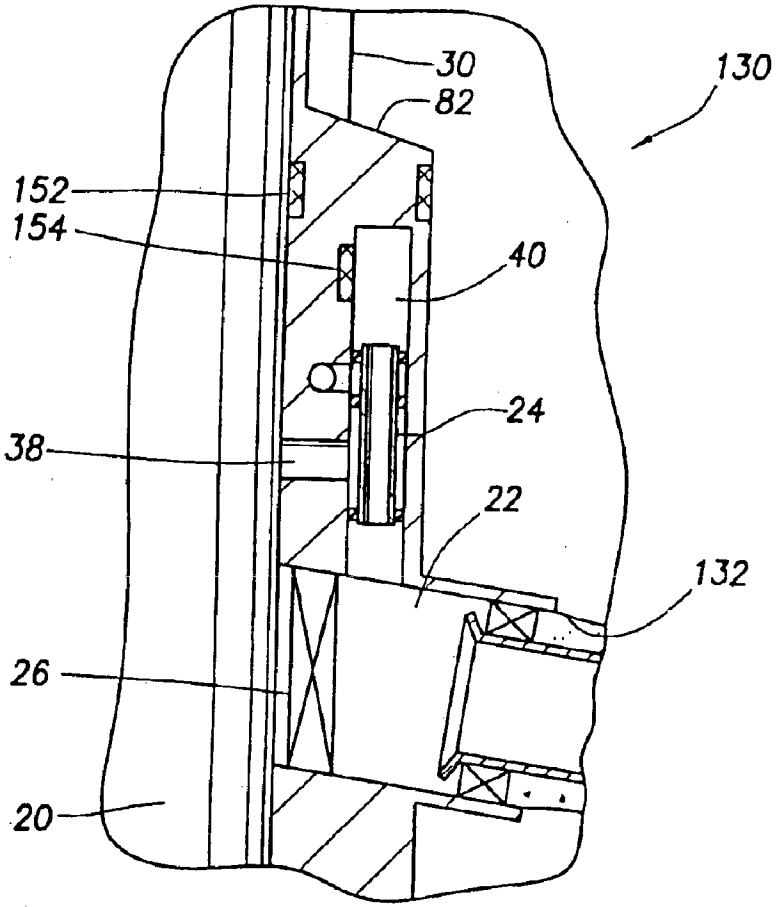
FIG. 13 is a cross-sectional view of the seventh system and method, showing a flow control device thereof in a closed configuration.

Referring additionally now to FIG. 13, a portion of the system 130 is depicted, showing the flow control device 24 in a configuration in which flow between the passage 22 and each of the passages 20, 62 is prevented. This configuration may be used in an emergency situation in which the flow control device 24 performs the function of a safety valve to shut off flow from the branch wellbore 132. Alternatively, this configuration may be used to perform a formation test in the branch wellbore 132, for example, using the pressure and temperature sensors 152, 154 as described above and in the incorporated application filed concurrently herewith.

Figure 14:
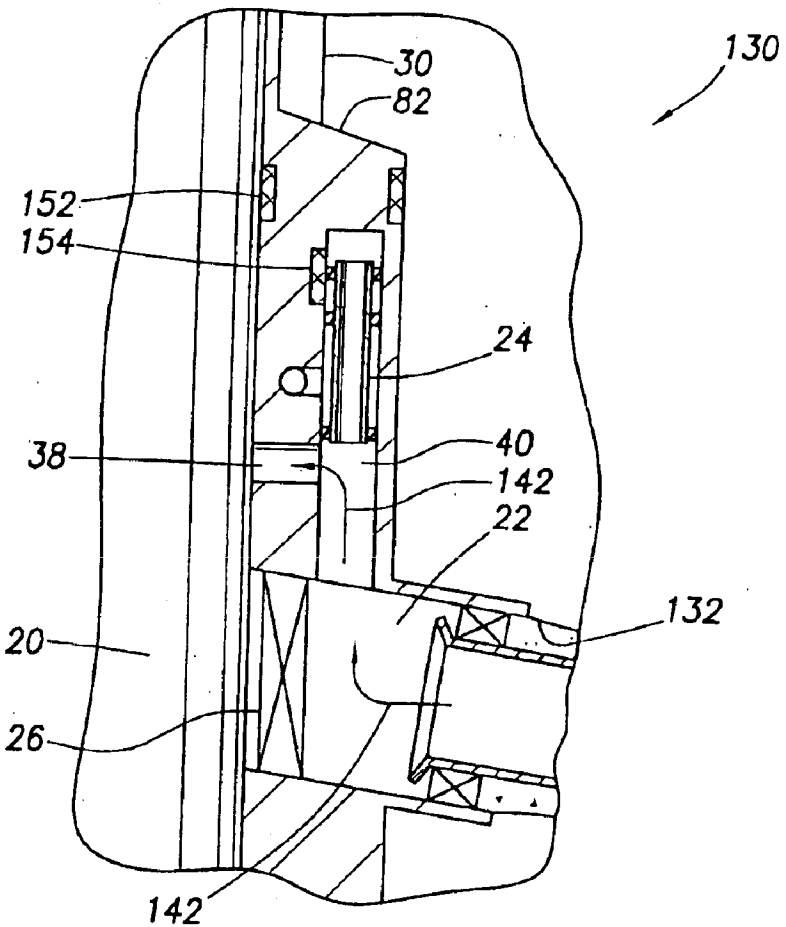
FIG. 14 is a cross-sectional view of the seventh system and method, showing a flow control device thereof in a producing configuration.

Referring additionally now to FIG. 14, the system 130 is depicted in a configuration in which the flow control device 24 permits flow between the passages 20, 22, but prevents flow between the passages 22, 62. This configuration may be used to produce the fluid 142 from the branch wellbore 132 directly through the casing string passage 28, without first passing the fluid through the separator 140 (for example, if the separator is not functioning properly). Alternatively, this configuration may be used for a formation test in the branch wellbore 132, where relatively unrestricted flow of the fluid 142 is desired or the flow control device 24 is used as a choke to regulate the flow of the fluid.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A system for completing a well having a wellbore, the system comprising:

first and second apparatuses interconnected in a casing string in the wellbore, an internal flow passage of the casing string extending through a first passage of each of the apparatuses, each of the apparatuses further having a second passage intersecting the first passage; and a third passage of each of the apparatuses providing fluid communication between the apparatuses separate from the casing string flow passage, and wherein the apparatuses are cemented in the wellbore by flowing cement through the third passages of the apparatuses.

2. A system for completing a well having a first wellbore, the system comprising:

first and second apparatuses interconnected in a casing string in the first wellbore, an internal flow passage of the casing string extending through a first passage of each of the apparatuses, each of the apparatuses further having a second passage intersecting the first passage; and a third passage of each of the apparatuses providing fluid communication between the apparatuses separate from the casing string flow passage, and wherein fluid is produced through the third passage of the first apparatus while a second wellbore is drilled through the second apparatus.

3. A system for completing a well having a wellbore, the system comprising:

first and second apparatuses interconnected in a casing string in the wellbore, an internal flow passage of the casing string extending through a first passage of each of the apparatuses, each of the apparatuses further having a second passage intersecting the first passage; and a third passage of each of the apparatuses providing fluid communication between the apparatuses separate from the casing string flow passage, and wherein a flow control device controls fluid flow between the second and third passages of the first apparatus.

4. A system for completing a well having a wellbore, the system comprising:

first and second apparatuses interconnected in a casing string in the wellbore, an internal flow passage of the casing string extending through a first passage of each of the apparatuses, each of the apparatuses further having a second passage intersecting the first passage; and a third passage of each of the apparatuses providing fluid communication between the apparatuses separate from the casing string flow passage, and wherein a flow control device controls fluid flow between the first and second passages of the first apparatus.

5. A system for completing a well having a wellbore, the system comprising:

first and second apparatuses interconnected in a casing string in the wellbore, an internal flow passage of the casing string extending through a first passage of each of the apparatuses, each of the apparatuses farther having a second passage intersecting the first passage; and a third passage of each of the apparatuses providing fluid communication between the apparatuses separate from the casing string flow passage, and wherein at least a portion of a flow control device of the first apparatus is retrievable from the well through the third passage of the first apparatus.

6. A system for completing a well having a wellbore, the system comprising:

first and second apparatuses interconnected in a casing string in the wellbore, an internal flow passage of the casing string extending through a first passage of each of the apparatuses, each of the apparatuses further having a second passage intersecting the first passage; and a third passage of each of the apparatuses providing fluid communication between the apparatuses separate from the casing string flow passage, and wherein the third passages of the apparatuses extend through a tubular string interconnected between the apparatuses.

7. A system for completing a well having a wellbore, the system comprising:

first and second apparatuses interconnected in a casing string in the wellbore, an internal flow passage of the casing string extending through a first passage of each of the apparatuses, each of the apparatuses further having a second passage intersecting the first passage; and a third passage of each of the apparatuses providing fluid communication between the apparatuses separate from the casing string flow passage, and wherein the third passages extend through an annulus between the casing string and the tubular string.

8. A system for completing a well having a wellbore, the system comprising:

first and second apparatuses interconnected in a casing string in the wellbore, an internal flow passage of the casing string extending through a first passage of each of the apparatuses, each of the apparatuses further having a second passage intersecting the first passage; and a third passage of each of the apparatuses providing fluid communication between the apparatuses separate from the casing string flow passage, and wherein one of the first and second apparatuses includes a separator for separating hydrocarbons and water from fluid received in the separator.

9. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein the third passage extends longitudinally through the mandrel, and wherein cement is flowed through the third passage between opposite ends of the mandrel.

10. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including multiple third passages extending longitudinally in the mandrel, and wherein a first flow control device selectively controls fluid communication between a first one of the third passages and the first passage, and a second flow control device selectively controls fluid communication between a second one of the third passages and the first passage.

11. The system according to claim 10, wherein the first flow control device selectively controls fluid communication between the first and second flow passages.

12. The system according to claim 11, wherein the second flow control device selectively controls fluid communication between the first and second flow passages.

13. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including multiple third passages extending longitudinally in the mandrel, and wherein a first flow control device selectively controls fluid communication between a first one of the third passages and the second passage, and a second flow control device selectively controls fluid communication between a second one of the third passages and the second passage.

14. The system according to claim 13, wherein the first flow control device selectively controls fluid communication between the first and second flow passages.

15. The system according to claim 14, wherein the second flow control device selectively controls fluid communication between the first and second flow passages.

16. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein the third passage is in fluid communication with a tubular string extending to a remote location.

17. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein a flow control device selectively controls fluid communication between the third passage and the first passage.

18. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein a flow control device selectively controls fluid communication between the third passage and the second passage.

19. A system for completing a well having intersecting first and second wellbores, the system comprising:

a casing string positioned in the first wellbore; and at least first and second mandrels interconnected in the casing string, each of the first and second mandrels having intersecting first and second passages formed therein, the first passage extending longitudinally through the mandrel and in fluid communication with an interior of the casing string, and the second passage extending laterally relative to the first passage and being configured for drilling the second wellbore therethrough, and each of the first and second mandrels further including at least one third passage extending longitudinally in the mandrel, and wherein the third passage of the first mandrel is in fluid communication with the third passage of the second mandrel via a tubular string interconnected between the first and second mandrels.

20. A system for completing a well having intersecting first and second wellbores, the system comprising:

a casing string positioned in the first wellbore; and at least first and second mandrels interconnected in the casing string, each of the first and second mandrels having intersecting first and second passages formed therein, the first passage extending longitudinally through the mandrel and in fluid communication with an interior of the casing string, and the second passage extending laterally relative to the first passage and being configured for drilling the second wellbore therethrough, and each of the first and second mandrels further including at least one third passage extending longitudinally in the mandrel, and wherein the third passage of the first mandrel is in fluid communication with the third passage of the second mandrel via an annulus formed between two tubular strings interconnected between the first and second mandrels.

21. A system for completing a well having intersecting first and second wellbores, the system comprising:

a casing string positioned in the first wellbore; and at least first and second mandrels interconnected in the casing string, each of the first and second mandrels having intersecting first and second passages formed therein, the first passage extending longitudinally through the mandrel and in fluid communication with an interior of the casing string, and the second passage extending laterally relative to the first passage and being configured for drilling the second wellbore therethrough, and each of the first and second mandrels further including at least one third passage extending longitudinally in the mandrel, the third passage of the first mandrel being in fluid communication with the third passage of the second mandrel, and wherein a flow control device is interconnected between the third passage of the first mandrel and the second passage of the first mandrel.

22. The system according to claim 21, wherein fluid is produced from the second wellbore into the third passage of the first mandrel through the flow control device.

23. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein a third wellbore is drilled by passing a drill string through the first passage, while fluid is produced from the second wellbore through the third passage.

24. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein a third wellbore is drilled by passing a drill string through the first passage, while fluid is injected into the second wellbore through the third passage.

25. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein a third wellbore is drilled by passing a drill string through the first passage, while the second wellbore is stimulated through the third passage.

26. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein a third wellbore is drilled by passing a drill string through the first passage, while a formation test is performed on the second wellbore through the third passage.

27. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein at least a portion of a flow control device of the apparatus is retrievable from the apparatus via a tubular string connected to the third passage and extending to a remote location.

28. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein the apparatus further includes a separator configured for separating hydrocarbons and water from fluid received into the apparatus.

29. A system for completing a well having intersecting first and second wellbores, the system comprising:

a casing string positioned in the first wellbore; and at least one apparatus interconnected in the casing string, the apparatus including a separator configured for separating hydrocarbons and water from fluid received into the apparatus, and a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein the separator is positioned in the third passage.

30. A system for completing a well having intersecting first and second wellbores, the system comprising:

a casing string positioned in the first wellbore; and at least one apparatus interconnected in the casing string, the apparatus including a separator configured for separating hydrocarbons and water from fluid received into the apparatus, and a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein the separator directs the hydrocarbons to flow into the first passage, and wherein the separator directs the water to flow out of the apparatus via the second passage.

31. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein first and second ones of the apparatus are interconnected in the casing string, the first apparatus receiving a fluid comprising a mixture of hydrocarbons and water, the fluid being flowed via the third passage of the first apparatus to the third passage of the second apparatus, the hydrocarbons being substantially separated from the water in the second apparatus, the hydrocarbons being produced via the first passage of the second apparatus, and the water being flowed out of the second apparatus via the second passage.

32. A system for completing a well having intersecting first and second wellbores, the system comprising:

a casing string positioned in the first wellbore; and at least one apparatus interconnected in the casing string, the apparatus including a mandrel having intersecting first and second passages formed therein, the first passage extending longitudinally through the mandrel and in fluid communication with an interior of the casing string, and the second passage extending laterally relative to the first passage and being configured for drilling the second wellbore therethrough, and the mandrel further including at least one third passage extending longitudinally in the mandrel, and wherein the apparatus further includes a three way flow control device which selectively permits fluid communication between the second passage and one of the first and third passages.

33. The system according to claim 32, wherein the third passage is in fluid communication with a separator configured for separating hydrocarbons and water from fluid flowed through the flow control device.

34. A method of drilling and completing a well having intersecting first and second wellbores, the method comprising the steps of:

interconnecting at least one apparatus in a casing string having an internal longitudinal flow passage formed therethrough, the apparatus including first and second passages formed therein, the first passage extending longitudinally through the apparatus and forming a portion of the casing string flow passage;

positioning the apparatus in the first wellbore at a location where it is desired to drill the second wellbore;

drilling the second wellbore by passing a drill string through the first and second passages; and flowing fluid between the second wellbore and a remote location through a third passage of the apparatus, the third passage being isolated from the first passage in the apparatus.

35. The method according to claim 34, wherein the interconnecting step further comprises interconnecting first and second ones of the apparatus in the casing string.

36. The method according to claim 35, wherein the flowing step further comprises flowing fluid through the third passage between the first and second apparatuses.

37. The method according to claim 35, wherein the flowing step further comprises flowing fluid between the second passage of the first apparatus and the second passage of the second apparatus.

38. The method according to claim 35, wherein the flowing step further comprises flowing the fluid through a tubular string extending between the first and second apparatus external to the casing string.

39. The method according to claim 35, wherein the flowing step further comprises flowing the fluid through an annulus formed between the casing string and a tubular string in the first wellbore.

40. The method according to claim 35, further comprising the step of drilling another wellbore through the second apparatus during the flowing step.

41. The method according to claim 34, wherein the flowing step further comprises producing fluid from the second wellbore through the third passage.

42. The method according to claim 41, wherein the fluid producing step further comprises performing a formation test on the second wellbore.

43. The method according to claim 41, wherein the flowing step further comprises flowing the fluid from the apparatus to another apparatus interconnected in the casing string.

44. The method according to claim 34, wherein the flowing step further comprises injecting fluid into the second wellbore through the third passage.

45. The method according to claim 44, wherein the fluid injecting step further comprises injecting water separated from the fluid in the second apparatus.

46. The method according to claim 44, wherein the fluid injecting step further comprises stimulating the second wellbore.

47. The method according to claim 44, wherein the flowing step further comprises receiving the fluid into the apparatus from another apparatus interconnected in the casing string.

48. The method according to claim 34, wherein the flowing step further comprises isolating the third passage from the casing string flow passage between the apparatus and the remote location.

49. The method according to claim 48, wherein the isolating step further comprises extending the third passage through a tubular string external to the casing string.

50. The method according to claim 49, wherein in the isolating step, the remote location is the earth's surface, and the tubular string extends between the apparatus and the earth's surface.

51. The method according to claim 34, wherein the flowing step further comprises controlling flow between the second wellbore and the third passage using a flow control device interconnected between the second and third passages.

52. The method according to claim 51, wherein the flow controlling step further comprises controlling flow between the first and second passages using the flow control device.

53. The method according to claim 51, wherein the flow controlling step further comprises controlling flow between the second passage and a selected one of the first and third passages using the flow control device.

54. The method according to claim 51, wherein there are multiple ones of the third passage in the apparatus, and wherein the flow controlling step further comprises controlling flow between the second passage and a selected one of the third passages.

55. A system for completing a well having intersecting first and second wellbores, the system comprising:

at least one apparatus positioned in the first wellbore and having first and second passages formed therethrough, the first passage forming a portion of an internal flow passage of a casing string in which the apparatus is interconnected, and the second passage providing access between the first passage and the second wellbore; and the apparatus further having a third passage isolated from the first passage while fluid is flowed between the third passage and the second wellbore.

56. The system according to claim 55, wherein fluid is flowed through the second passage between the third passage and the second wellbore.

57. The system according to claim 55, wherein fluid is produced from the second wellbore through the third passage.

58. The system according to claim 57, wherein fluid is produced from the second wellbore during a formation test in the second wellbore.

59. The system according to claim 57, wherein fluid flows through the third passage to a third wellbore intersecting the first wellbore.

60. The system according to claim 59, wherein the third wellbore extends outward from another apparatus interconnected in the casing string.

61. The system according to claim 55, wherein fluid is flowed into the second wellbore from the third passage.

62. The system according to claim 61, wherein fluid is flowed into the second wellbore during stimulation of the second wellbore.

63. The system according to claim 61, wherein fluid is flowed into the second wellbore from a third wellbore intersected by the first wellbore.

64. The system according to claim 63, wherein fluid flowed into the second wellbore is separated from fluid produced from the third wellbore.

65. The system according to claim 64, wherein the fluid flowed into the second wellbore includes water separated from hydrocarbons in the fluid produced from the third wellbore.

66. The system according to claim 64, wherein the fluid flowed into the second wellbore includes hydrocarbons separated from water in the fluid produced from the third wellbore.

67. The system according to claim 55, wherein the apparatus further includes a flow control device controlling flow between the third passage and the second wellbore.

68. The system according to claim 67, wherein the flow control device further controls flow between the first and second passages.

69. The system according to claim 68, wherein flow directly between the first and second passages is blocked while the flow control device controls flow between the second passage and a selected one of the first and third passages.

70. The system according to claim 55, wherein there are first and second ones of the apparatus interconnected in the casing string, and wherein the third passage extends between the first and second apparatuses.

71. The system according to claim 70, wherein the third passage extends through a tubular string interconnected between the first and second apparatuses.

72. The system according to claim 71, wherein the tubular string extends between the first and second apparatuses external to the casing string.

73. The system according to claim 71, wherein the third passage extends through an annulus formed between the tubular string and the casing string.

74. The system according to claim 55, wherein the apparatus has multiple third passages, and a flow control device controlling flow between the second passage and a selected one of the third passages.

75. The system according to claim 55, wherein the apparatus includes a flow control device controlling flow between the second and third passages.

76. The system according to claim 75, wherein the flow control device further controls flow between the first and second passages.

77. The system according to claim 55, wherein the apparatus includes first and second flow control devices, the first flow control device controlling flow between the first and second passages, and the second flow control device controlling flow between the second and third passages.

78. The system according to claim 55, wherein the apparatus has multiple third passages, and first and second flow control devices, the first flow control device controlling flow between the second passage and a first one of the third passages, and the second flow control device controlling flow between the second passage and a second one of the third passages.

79. The system according to claim 78, wherein at least one of the first and second flow control devices also controls flow between the first and second passages.

80. The system according to claim 78, wherein at least one of the first and second flow control devices also controls flow between the first passage and one of the third passages.

81. The system according to claim 55, wherein at least a portion of a flow control device of the apparatus is retrievable from the apparatus via a tubular string connected to the third passage and extending to a remote location.

82. The system according to claim 55, wherein the apparatus further includes a separator configured for separating hydrocarbons and water from fluid received into the apparatus.

83. The system according to claim 82, wherein the separator is positioned in the third passage.

84. The system according to claim 82, wherein the fluid is received into the apparatus through the third passage.

85. The system according to claim 82, wherein the fluid is received into the apparatus from another apparatus interconnected in the casing string.

86. The system according to claim 82, wherein the separator directs hydrocarbons to flow into the first passage, and directs water to flow into the second wellbore through the second passage.

87. The system according to claim 55, wherein first and second ones of the apparatus are interconnected in the casing string, the first apparatus receiving a fluid comprising a mixture of hydrocarbons and water, the fluid being flowed via the third passage of the first apparatus to the third passage of the second apparatus, the hydrocarbons being substantially separated from the water in the second apparatus, the hydrocarbons being produced via the first passage of the second apparatus, and the water being flowed out of the second apparatus via the second passage.

88. The system according to claim 55, wherein the apparatus further includes a three way flow control device which selectively permits fluid communication between the second passage and one of the first and third passages.

89. The system according to claim 88, wherein the third passage is in fluid communication with a separator configured for separating hydrocarbons and water from fluid flowed through the flow control device.

90. A method of completing a well having a first wellbore intersecting each of second and third wellbores, the method comprising the steps of:

interconnecting first and second apparatuses in a casing string, each of the apparatuses having a first passage formed therethrough which forms a portion of an internal flow passage of the casing string, and a second passage intersecting the first passage and extending laterally relative to the first passage;

positioning the casing string in the first wellbore; and receiving fluid from one of the second and third wellbores into one of the first and second apparatuses;

separating hydrocarbons and water from the fluid received into the one of the first and second apparatuses; and flowing one of the separated hydrocarbons and water to the other of the first and second apparatuses through a third passage interconnected between the first and second apparatuses.

91. The method according to claim 90, wherein in the receiving step, the fluid is received into the first apparatus, and wherein in the flowing step, the separated water is flowed to the second apparatus through the third passage.

92. The method according to claim 90, wherein in the receiving step, the fluid is received into the first apparatus, and wherein in the flowing step, the separated hydrocarbons are flowed to the second apparatus through the third passage.

93. The method according to claim 90, wherein the separating step further comprises separating the hydrocarbons from the water using a separator of the one of the first and second apparatuses.

94. The method according to claim 93, wherein in the separating step, the separator is a centrifugal separator.

95. The method according to claim 94, wherein in the separating step, the separator extends circumferentially about the first passage of the one of the first and second apparatuses.

96. The method according to claim 90, wherein the separating step further comprises directing the separated hydrocarbons to flow into the first passage of the one of the first and second apparatuses.

97. The method according to claim 90, wherein the separating step further comprises directing the separated water to flow to the other of the first and second apparatuses through the third passage.

98. The method according to claim 90, wherein the separating step is performed by a separator positioned within an annular space formed about the casing string flow passage.

99. The method according to claim 90, wherein the separating step is performed by a separator positioned within an annular space formed in the other of the first and second apparatuses.

100. The method according to claim 90, wherein the separating step is performed by a separator positioned within an annular space formed about the first passage.

101. The method according to claim 90, wherein the separating step is performed by a separator retrievable from within the casing string.

* * * * *

UNITED STATES PATENT AND TRADEMARK OFFICE

CERTIFICATE OF CORRECTION

PATENT NO. : 6,863,126 B2
DATED : March 8, 2005
INVENTOR(S) : McGlothen et al.

It is certified that error appears in the above-identified patent and that said Letters Patent is hereby corrected as shown below:

Title page,
Item [54], Title, delete "MULTILAYER" and insert in place thereof
-- MULTILATERAL --.

Signed and Sealed this

Sixteenth Day of August, 2005

JON W. DUDAS
*Director of the United States Patent and Trademark Office*